United States Patent [19]

Gaudin

[11] Patent Number: 4,776,722

[45] **Date of Patent: * Oct. 11, 1988**

[54] SELF SEALING SEWER COVER ASSEMBLY

[76] Inventor: Carl J. Gaudin, 9526 Foster Rd., Baton Rouge, La. 70811

[ * ] Notice: The portion of the term of this patent subsequent to Jul. 28, 2004 has been disclaimed.

[21] Appl. No.: 16,569

[22] Filed: Feb. 19, 1987

Related U.S. Application Data

[63] Continuation-in-part of Ser. No. 846,751, Apr. 1, 1986, Pat. No. 4,682,907.

[51] Int. Cl.[4] ..... E02D 29/14

[52] U.S. Cl. ..... 404/25; 210/164

[58] Field of Search ..... 404/25, 26; 52/19–21; 210/164, 165

[56] References Cited

U.S. PATENT DOCUMENTS

| | | | |
|---|---|---|---|
| 129,246 | 7/1872 | Ober | 52/20 |
| 530,816 | 12/1894 | Wright | 210/164 X |
| 543,617 | 7/1985 | Dunstan | 210/164 X |
| 780,572 | 1/1905 | McQuistion | 210/164 X |
| 835,852 | 11/1906 | Farley | 210/164 X |
| 1,033,448 | 7/1912 | Mueller | 404/26 X |
| 1,507,531 | 9/1924 | Vaudell | 210/164 X |
| 1,686,415 | 10/1928 | Lyes | 210/164 X |
| 2,095,024 | 10/1937 | Boosey | 210/165 X |
| 2,783,852 | 3/1957 | Sisk | 210/165 |
| 3,516,541 | 6/1970 | Hardingham | 210/164 |
| 3,556,993 | 1/1971 | Persson | 210/164 |
| 3,621,623 | 11/1971 | Dowens | 52/20 |
| 3,713,539 | 1/1973 | Thompson et al. | 210/164 |
| 4,045,346 | 8/1977 | Swaskey | 210/164 |
| 4,305,679 | 12/1981 | Modi | 404/25 |
| 4,419,232 | 12/1983 | Arntyr et al. | 210/164 |
| 4,682,907 | 7/1987 | Gaudin | 404/25 |

FOREIGN PATENT DOCUMENTS

| | | | |
|---|---|---|---|
| 38641 | 6/1931 | France | 210/164 |
| 1162778 | 2/1964 | Fed. Rep. of Germany | 210/164 |
| 2803959 | 8/1979 | Fed. Rep. of Germany | 210/164 |

*Primary Examiner*—Stephen J. Novosad
*Assistant Examiner*—John F. Letchford
*Attorney, Agent, or Firm*—David L. Ray

[57] ABSTRACT

A self sealing sewer cover assembly for preventing flammable gases from being discharged from a sewer and for preventing the ignition of gases in a sewer by flames and sparks in the adjacent to the sewer inlet. The apparatus of the present invention comprises a cover assembly which may replace or be used in combination with an existing cover or grating on a sewer inlet and may be inserted into the inlet to a sewer. The apparatus of the present invention provides a water barrier between gases contained in the sewer and the ambient air adjacent to the sewer inlet which prevents the flow of gases from the sewer to the ambient air surrounding the sewer inlet.

20 Claims, 6 Drawing Sheets

SELF SEALING SEWER COVER ASSEMBLY

CROSS REFERENCE TO RELATED APPLICATION

This application is a continuation-in-part of U.S. patent application Ser. No. 06/846,751 filed Apr. 1, 1986 now U.S. Pat. No. 4,682,907.

BACKGROUND OF THE INVENTION

1. Field of the Invention

The present invention is related to an apparatus for preventing explosive vapors contained in a sewer from being transmitted to the atmosphere surrounding the sewer. More particularly, the present invention relates to apparatuses for insertion into existing sewer inlets commonly covered by gratings or other sewer covers which prevent explosive vapors contained in the sewer from being ignited by sparks or flames in the atmosphere on the outside of the sewer.

2. Description of the Prior Art

Industries which manufacture and process flammable liquids and gases such as hydrocarbons have difficulty in keeping the hydrocarbons and other flammable liquids from finding their way into the sewer system located beneath the manufacturing facility. Flammable liquids and gases which enter such sewer systems can be easily ignited by welding or cutting operations occurring in the vicinity of the inlets to the sewer system.

Such problems are commonly encountered in the petroleum refining industry. In most petroleum refining facilities elaborate systems are used to recover hydrocarbons in the sewer system for processing into useful product.

Hydrocarbons and other flammable liquids and gases are ever present in the sewer systems of petroleum refiners, and precautions must be taken when performing burning and welding in the facility of sewer inlets. Commonly, the sewer inlet is covered with a vinyl coated canvas having a border filled with sand or sawdust to prevent flammable gases in the sewer from being ignited by burning or welding operations in the refinery. The vinyl cover has a reservoir to retain water which adds weight to the interior of the cover to improve the seal over the inlet. The area immediately surrounding a sewer inlet may be gravel or dirt, but in most cases the surrounding area is either asphalt or concrete.

When the area surrounding a sewer cover is asphalt or concrete it is extremely difficult to seal the perimeter of the sewer cover, even using a vinyl coated canvas cover filled with water, sand and/or sawdust. In addition to placing the sewer cover over the inlet or man way and filling it with water, sand must be placed around the outside of the border to aid in sealing the sewer inlet from the surrounding area. Such a seal is necessary to prevent flammable gases from escaping from the sewer inlet and to keep sparks from burning and welding operations from entering the sewer system and igniting flammable gases therein.

Commonly, in a petroleum refinery while burning or welding is in progress, a water spray is directed toward the sparks generated by the burning and welding to cool the metal being welded or cut and to cool any molten pieces of metal falling from the work area. Canvas blankets are sometimes placed around the site of the burning or welding while the burning or welding is in progress, and a water spray is directed to the exterior of the canvas blankets to prevent sparks from entering the sewer and coming into contact with flammable liquids or gases in the sewer.

Such measures provide minimal protection from explosion and/or fires in the sewer systems of petroleum refiners and other chemical processing plants. The perimeter of the sewer cover even when covered with sand may still allow flammable gases and hot sparks to come into contact with each other, even though canvas blankets may be placed around the site of the cutting or welding.

U.S. Pat. No. 4,305,679 discloses a man hole sealing device to prevent water from entering a man hole through the corbel joint between the man hole casing and the cover frame. The cover disclosed completely seals a man hole. Such a device would not be pertinent to the present invention in which water flow into a sewer is permitted rather than completely stopped.

U.S. Pat. No. 4,045,346 discloses a basement sewer trap comprising a coupling sleeve for a sewer pipe having an interior cup or well, the interior of the cup supporting a funnel tube beneath a water strainer. The water flows through the strainer, down through the funnel tube, upward out of the cup portion, and finally down the open end of the coupling sleeve into a sewer pipe.

U.S. Pat. No. 3,621,623 discloses an apparatus for temporarily closing an opening formed at the top of a vertical wall of a catch basin, man hole or the like, the man hole arrangement employing a trough type member 32 having a removable lid 31 is disclosed in FIG. 6. However, the lid completely closes the man hole and does not allow any flow therethrough, whereas in the present invention it is necessary to have fluid flow through the sewer cover.

U.S. Pat. No. 3,516,541 discloses a drain device comprising a prefabricated structure that may be removably mounted in a vertical drain structure which when partially filled with water provides a seal to prevent upward discharge of explosive vapors through the drain structure into the ambient atmosphere. The structure disclosed therein comprises a first cylinder open at the top and bottom contained within a second outer cylinder having a series of holes therein through which water flowing downwardly through the first cylinder and outwardly from the bottom of the first cylinder may exit.

U.S. Pat. No. 129,246 discloses a cover "E" which is placed on the cap ring of the mouth of a water pipe gate and two other covers "GG" which are placed over pyramidal or conical sections to form a dead air space therebetween.

SUMMARY OF THE INVENTION

In accordance with the present invention there is provided a self sealing sewer cover assembly for preventing flammable gases from being discharged from a sewer and for preventing the ignition of gases in a sewer by flames and sparks in the area adjacent to the sewer inlet. The apparatus of the present invention comprises a cover assembly which may replace or be used in combination with an existing cover or grating on a sewer inlet andmay be inserted into the inlet to a sewer. The apparatus of the present invention provides a water barrier between gases contained in the sewer and the ambient air adjacent to the sewer inlet which prevents the flow of gases from the sewer to the ambient air surrounding the sewer inlet.

In one embodiment of the present invention there is provided a self sealing sewer cover assembly for preventing flammable gases from escaping from a sewer including an insert for placement in a sewer inlet, the insert having a top end and bottom end, the insert having exterior vertical walls for parallel alignment with the vertical interior walls of the sewer inlet, the insert having a trough at the bottom end thereof extending completely around the interior of the exterior vertical walls of the insert for containing water, the trough having an inner vertical wall defining an opening through which water overflowing from the trough can flow, the inner vertical wall having a height less than the height of the exterior vertical wall of the insert, and a lid for placing in the trough and over the opening defined by the trough to prevent gases from traveling through the opening when the trough is filled with water while permitting liquids to flow through the trough openings located in the lid. A removable screen is positioned over the insert to facilitate cleaning of the insert.

The sewer cover assembly of the present invention keeps the sewer sealed at all times to prevent any flames or sparks outside of the sewer inlet from igniting gases contained in the sewer. The cover assemblies of the invention are low in cost and easily installed in existing sewer inlets.

DESCRIPTION OF THE PREFERRED EMBODIMENTS

Figure 1:
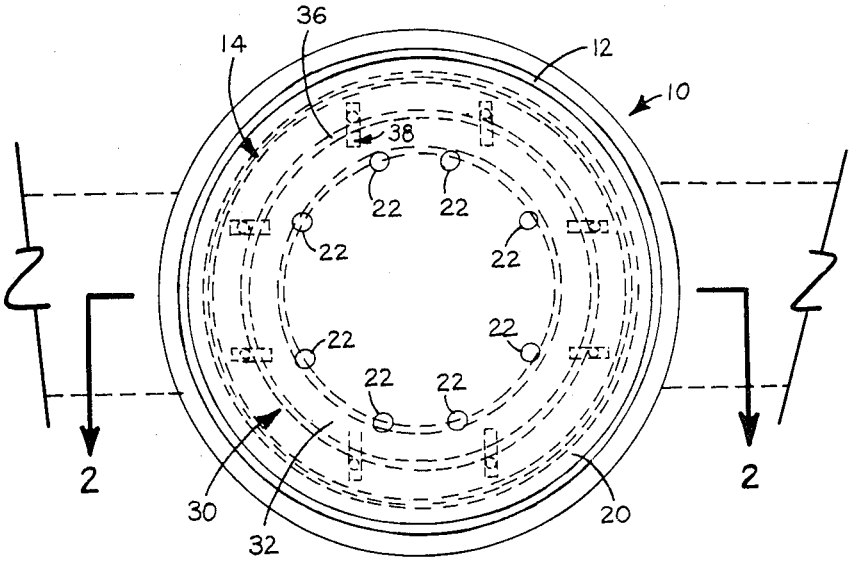
FIG. 1 is a top plan view of first embodiment of the cover assembly of the present invention.
Figure 2:
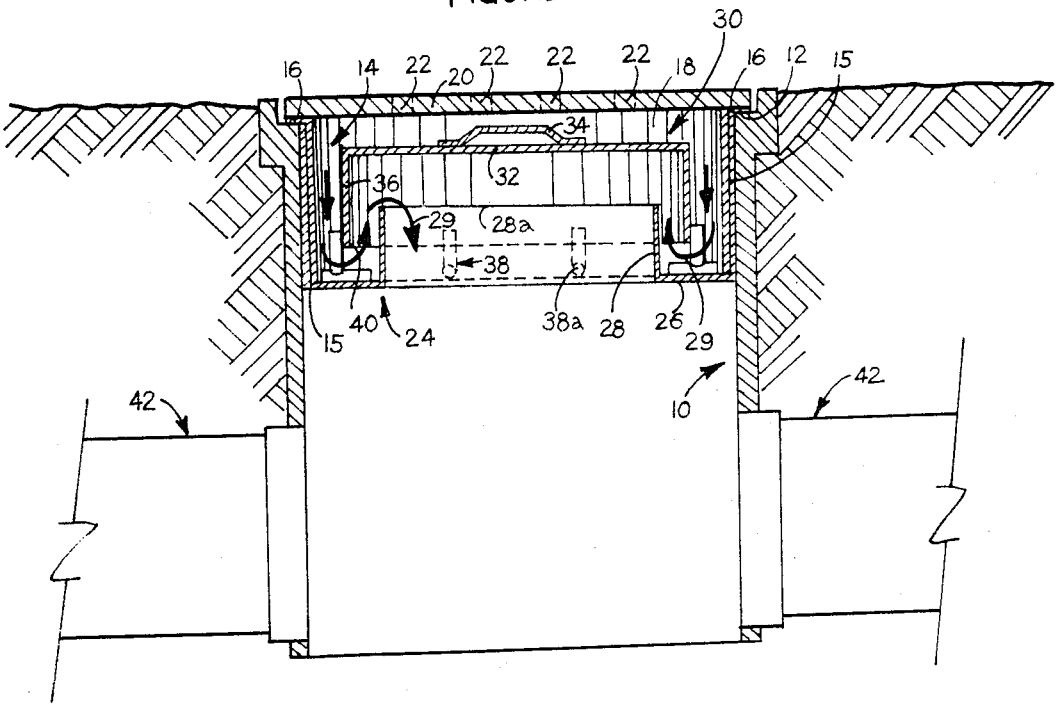
FIG. 2 is a vertical cross-sectional view of the first embodiment of the self sealing sewer cover assembly of the present invention taken along lines 2–2 of FIG. 1.
Figure 3:
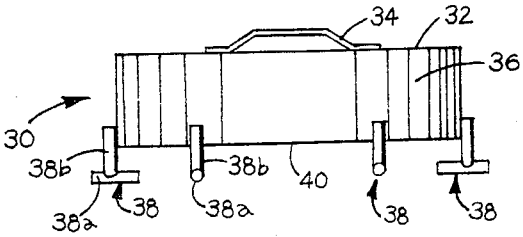
FIG. 3 is an elevational view of the lid shown in FIG. 2.

Referring now to the drawings and in particular to the embodiment shown in FIGS. 1 through 3, a cylindrical sewer inlet is generally indicated by the numeral 10. The sewer inlet has a recessed shoulder 12 at the top end thereof on which the generally cylindrical insert generally indicated by the numerals 14 is received. Insert 14 preferably provided with an annular lip 16 which rests upon shoulder 12.

As can be seen in FIG. 2, the exterior diameter of insert 14 is less than the interior diameter of sewer inlet 10, thereby allowing insert 14 to be placed in the interior of sewer inlet 10. Preferably a sealing material 15 such as glue, cement, or the like is placed around the exterior walls of insert 14 to form a gas seal between the exterior of vertical wall 18 of insert 14 and the interior walls of sewer inlet 10. Lip 16 of insert 14 defines an opening in the top of insert 14 through which liquid and other fluids may pass. Lying on top of lip 16 is removable cover 20 which has a series of channels or openings 22 therein through which liquids may flow downwardly into the interior of insert 14. Cover 20 is a common sewer inlet cover which lies on top of a sewer inlet and is held in place by gravity.

At the bottom end of insert 14 is a trough generally indicated by the numerals 24. Trough 24 is defined by horizontal annular plate 26 connected to vertical walls 18 of insert 14. Connected to annular plate 26 perpendicularly thereto is interior wall 28. Trough 24 thus defines a compartment extending completely around the interior of insert 14 into which the water may be poured and contained. As can be seen in FIG. 2, the height of interior wall 28 is less than the height of exterior wall 18 of insert 14.

In FIG. 3 is shown a lid generally indicated by the numeral 30. Lid 30 has a horizontal top plate 32 which is circular in shape and has handle 34 connected thereto. Extending perpendicularly down from the perimeter of circular top 32 is vertical exterior wall 36 of lid 30. Wall 36 has a series of supports 38 connected at the bottom thereof to support wall 36 at a desired distance above the bottom 26 of trough 24, the bottom edge 40 of lid 30 being beneath the top edge 28*a* of trough 24.

Although walls 18, 28 and 36 are preferably vertical as shown in FIGS. 1 and 2, they could be constructed at a small angle with the vertical as will be understood by those skilled in the art.

Thus when trough 24 is filled with water traveling downwardly through openings 22 of cover 20, water will rise to the level equal to the top edge 28*a* of trough 24 and will flow over the edge 28*a* through the opening defined by interior wall 28 of trough 24 in a direction indicated by the arrows 29 and downwardly to the sewer lines 42 connected to the base of sewer inlet 10.

The supports 38 for holding lid 30 may be of any desired design as long as the bottom edge 40 of the exterior wall of 36 of lid 30 is above bottom plate 26 and beneath the top edge 28*a* of vertical wall 28 of trough 24. Supports 38 preferably include a horizontal member 38*a* connected to a vertical member 38*b* as shown in FIG. 3 which is rigidly connected to wall 36.

If it si desired to clean the sewer inlet 10 or to place equipment downward in sewer inlet 10, cover 20 may be removed, and lid e0 may be removed through the use of handle 34, thereyb exposing the opening defined by vertical wall 28.

Figure 4:
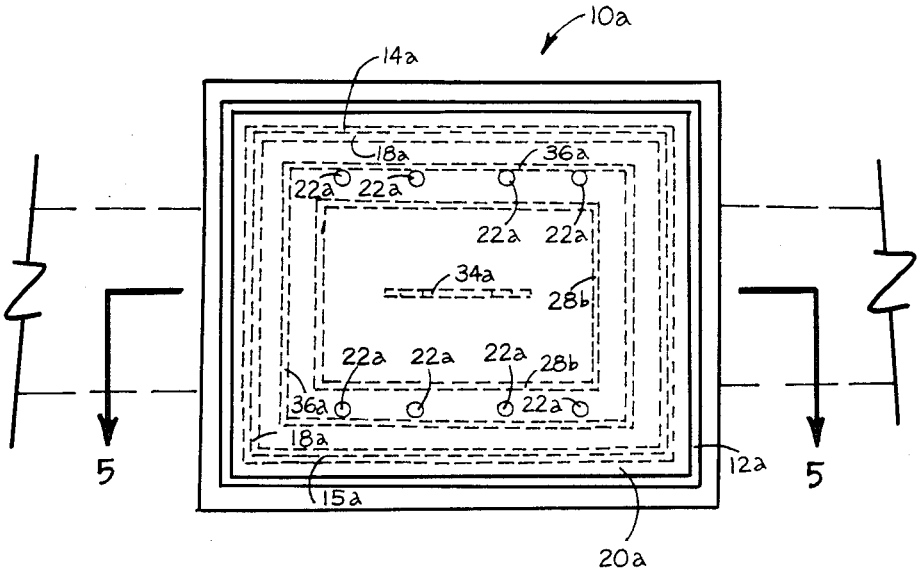
FIG. 4 is a top plan view of the cover assembly of of the present invention incorporating an alternate embodiment of a lid.
Figure 5:
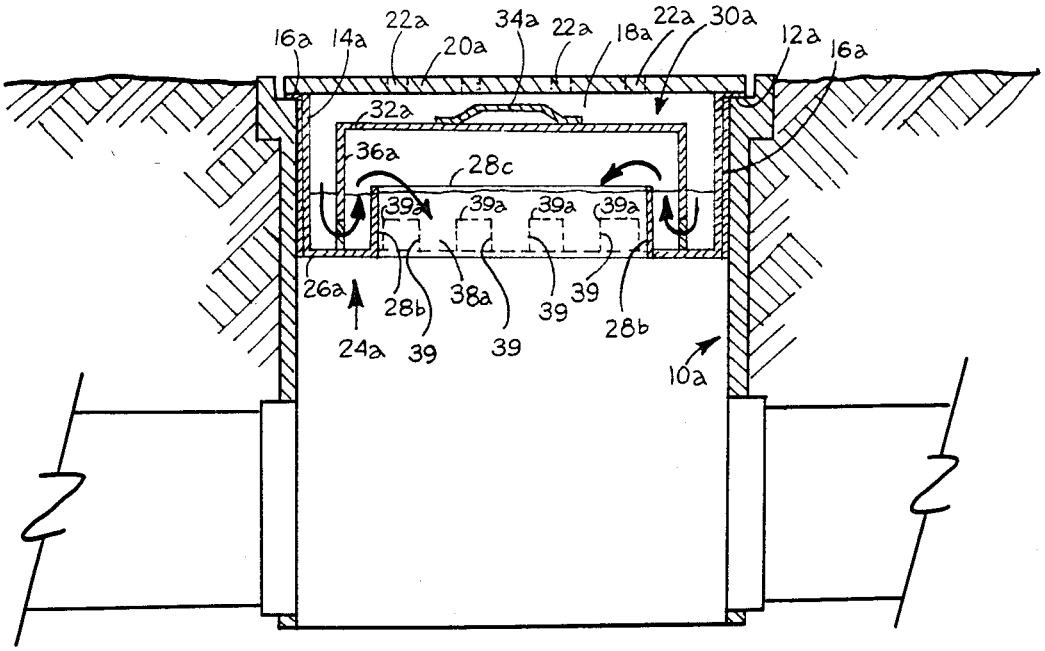
FIG. 5 is a vertical cross-sectional view taken along lines 5–5 of FIG. 4.
Figure 5A:
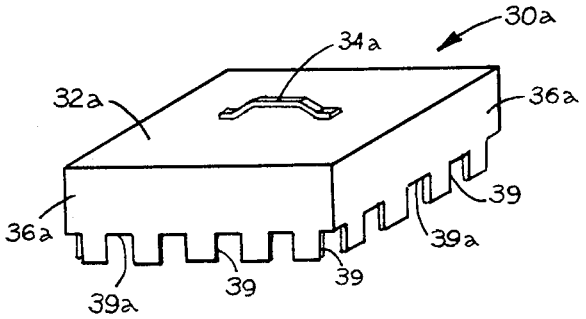
FIG. 5*a* is a perspective view of the lid shown in FIG. 5.

In FIGS. 4, 5, and 5*a* are shown a sewer cover assembly similar to the embodiment shown in FIGS. 1 through 3 with the exception that the support means for lid 30 are different and the cover and insert is in the shape of a rectangle rather than a circle.

A sewer inlet having a rectangular cross section is generally indicated by the numerals 10 *a* in FIG. 5. The sewer inlet 10a has a recessed shoulder 12a at the top end thereof on which the generally rectangular insert indicated by the numerals 14a is received. Insert 14a preferably is provided with an annular lip 16a which rests upon shoulder 12a.

As can be seen in FIGS. 4 and 5, the length and width of insert 14a is less than the length and width of sewer inlet 10a, whereby allowing insert 14a to be placed in the interior of sewer inlet 10a. Preferably a sealing material 15a such as glue, cement, or the like is placed around the exterior walls of insert 14a to form a gas seal between the exterior of vertical wall 18a of insert 14a and the interior walls of sewer inlet 10a. Lip 16a of insert 14a defines an opening in the top of insert 14a through which liquid and other fluids may pass. Lying on top of lip 16a is removable cover 20a which has a series of channels or openings 22a therein through which liquids may flow downwardly into the interior of insert 14a. Cover 20a is a common sewer inlet cover which lies on top of a sewer inlet and is held in place by gravity.

At the bottom end of insert 14a is a trough generally indicated by the numerals 24a. Trough 24a is defined by horizontal rectangular shaped plate 26a connected to vertical walls 18a of insert 14a. Connected to rectangular plate 26a perpendicularly thereto is interior wall 28b. Trough 24a thus defines a compartment extending completely around the interior of insert 14a into which the water may be poured and contained. As can be seen in FIG. 5, the height of interior wall 28b is less than the height of exterior wall 18a of insert 14a.

A lid generally indicated by the numeral 30a is shown in FIGS. 5 and 5a. Lid 30a has a horizontal top plate 32a which i rectangular in shape and has handle 34a connected thereto. Extending perpendicularly down from the perimeter of rectangular top 32a are vertical exterior walls 36a of lid 30a. Walls 36a have a series of openings 39 therein at the bottom thereof through which water may flow. The top 39a of openings 39 can be seen in FIG. 5 to be beneath the top edge 28c of trough 24a. Although walls 18a, 28b, and 36a are preferably vertical as shown in FIGS. 4, 5 and 5a, they could be constructed at a small angle with the vertical as will be understood by those skilled in the art.

Thus when trough 24a is filled with water traveling downwardly through openings 22a of cover 20a, water will rise to the the top edge 28c of trough 24a and will flow over the edge 28c through the opening defined by interior wall 28b of trough 24a in a direction indicated by the arrows 29a and downwardly to the sewer lines 42 connected to the base of sewer inlet 10.

If it is desired to clean the sewer inlet 10a or to place equipment downward in sewer inlet 30a, cover 20a may be removed and lid 30a may be removed through the use of handle 34a, thereby exposing the opening defined by vertical wall 28b.

Figure 6:
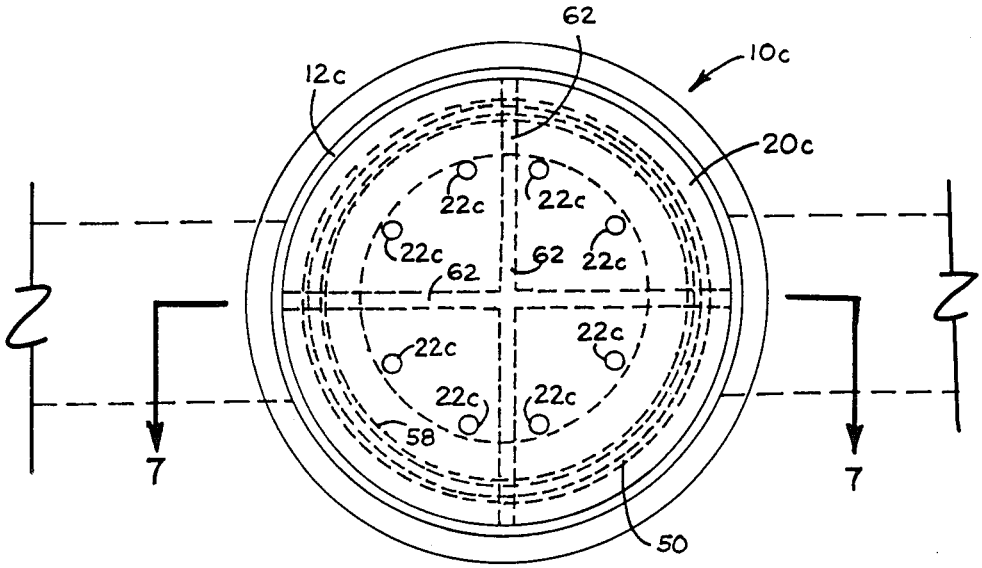
FIG. 6 is a top plan view of a second embodiment of the present invention.
Figure 7:
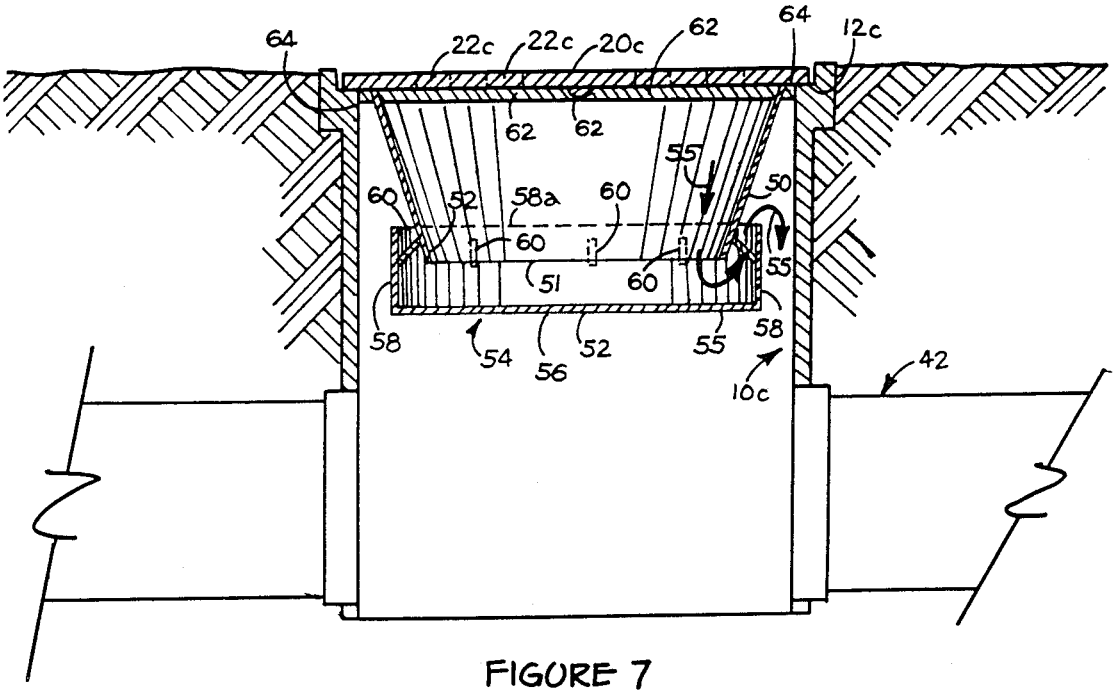
FIG. 7 is a vertical cross-sectional view taken along lines 7–7 of FIG. 6.

Referring now to the embodiment shown in FIGS. 6 and 7, a sewer inlet 10c has a lip 12c and and has the same horizontal flow lines 42 as does the sewer inlet shown in FIG. 2. Connected to the bottom side of cover 20c is conduit 50 which, in the embodiment shown in FIG. 7, has the shape of truncated cone. However, conduit 50 could be a standard cylindrical pipe having parallel side walls if desired so long as all the openings 22c in cover 20c are arranged so that water flowing therethrough flows into the interior of conduit 50. Conduit 50 is connected to cover 20c by welding, screwing, or the like.

Conduit 50 has connected at its bottom end 52 a pan 54 having a circular horizontal bottom 56 and vertical side walls 58 extending perpendicularly upward from circular bottom 56. Pan 54 is connected to the exterior of conduit 50 by a plurality of spaced apart braces 60 which may be connected to pan 54 and conduit 50 by welding, screwing, or the like. Braces 60 are spaced apart to permit water to flor therebetween. The top edge 58a of pan 54 is higher than the bottom edge 51 of conduit 50.

Thus, when pan 54 is filled with water, a water trap is formed therein which prevents gas in the interior of sewer inlet 10c from escaping upwardly through conduit 50. However, water coming downward through conduit 50 enters pan 54 and excess water is forced outwardly over the top edge 58a of exterior wall 58 of pan 54 as indicated by the arrows 55. If desired, reinforcing rods 62 may be utilized to connect conduit 50 to cover 20c. Preferably, a gasket or seal 64 of some common type such as rubber, glue, or cement may be placed around the exterior of the upper end of conduit 50 to seal the upper end of conduit 50 to the interior wall of sewer inlet 10 to prevent any gas from escaping upwardly around the outside of conduit 50 to the atmosphere adjacent to cover 20c.

Figure 8:
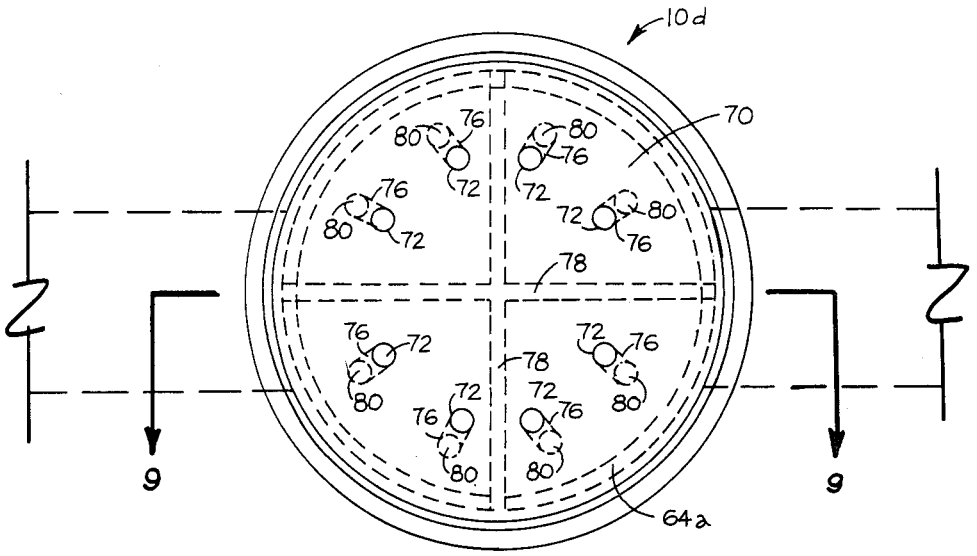
FIG. 8 is a top plan view of a third embodiment of the present invention.
Figure 9:
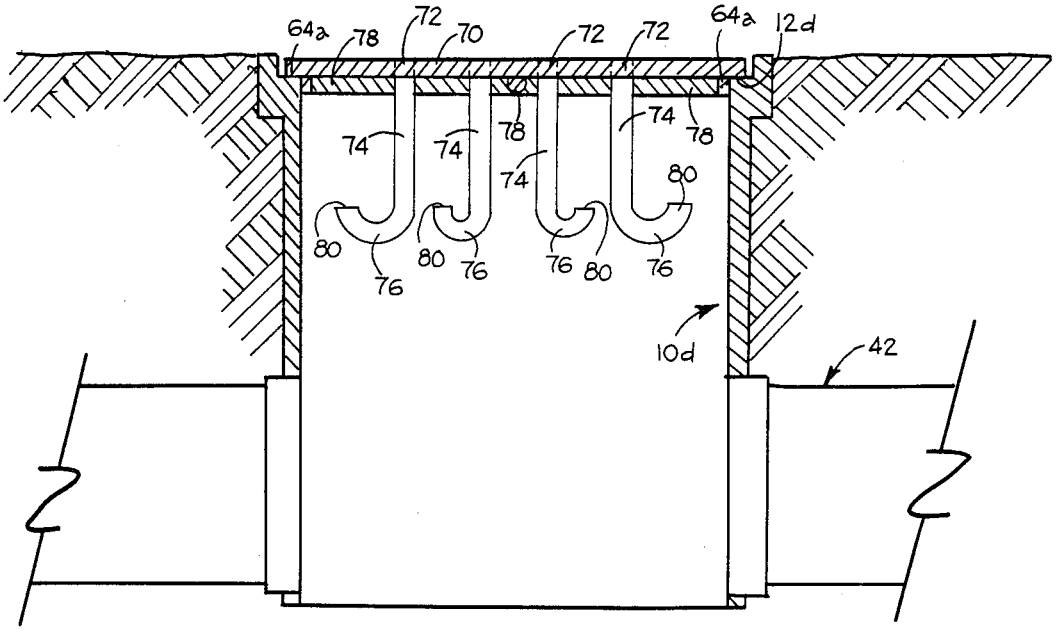
FIG. 9 is a vertical cross-sectional view taken along 9–9 of FIG. 8.

Referring now to the embodiment shown in FIGS. 8 and 9, sewer inlet 10d has horizontal flow line 42 connected thereto and annular shoulder 12d at the upward end thereof as previously described in the other embodiments. A cover 70 has a series of channels 72 therein which are aligned with pipes 74. Pipes 74 have the general shape of a "J" and have a "U" shaped bottom portion 76 which, when filled with water, forms a gas trap which prevents gases from flowing upwardly from the interior of sewer inlet 10d to the atmosphere adjacent to sewer cover 70. If desired, reinforcement members 78 can be added. Preferably, a gasket or seal 64a of some common type such as rubber glue, or cement may be placed around the exterior of the upper end of conduit 50 to seal the upper end of conduit 50 to the interior wall of sewer inlet 10d to prevent any gas from escaping upwardly around the outside of conduit 50 to the atmosphere adjacent to cover 20c.

Thus, any water flowing onto cover 70 will flow downward through channels 72 and into the "U"-shaped portion 76 of pipe 74. After water has filled the "U"-shaped portion 76 of pipe 74, no gas can escape through pipe 74 since the open end 80 of "U"-shaped pipe 74 will be covered with water through which gas can not flow. However, water can flow out of the open end 80 of pipes 74.

In FIGS. 10, 11, 12, and 13 are shown a sewer cover assembly similar to the embodiment shown in FIGS. 4 through 5a with the exception that the support means for lid 30a are different and a screen assembly generally indicated by the numeral 85 is placed inside insert 14a.

Figure 10:
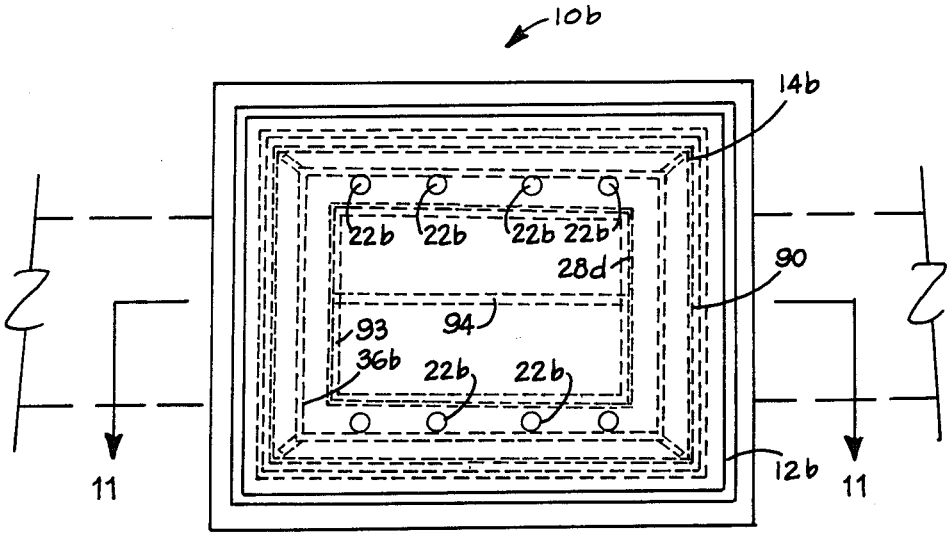
FIG. 10 is a top plan view of the cover assembly of the present invention incorporating a screen assembly.

A sewer inlet having a rectangular cross section is generally indicated by the numeral 10b in FIG. 10. The sewer inlet 10b has a recessed shoulder 12b at the top end thereof on which the generally rectangular insert indicated by the numeral 14b is received. Insert 14b preferably is provided with an annular lip 16b which rests upon shoulder 12b.

Figure 11:
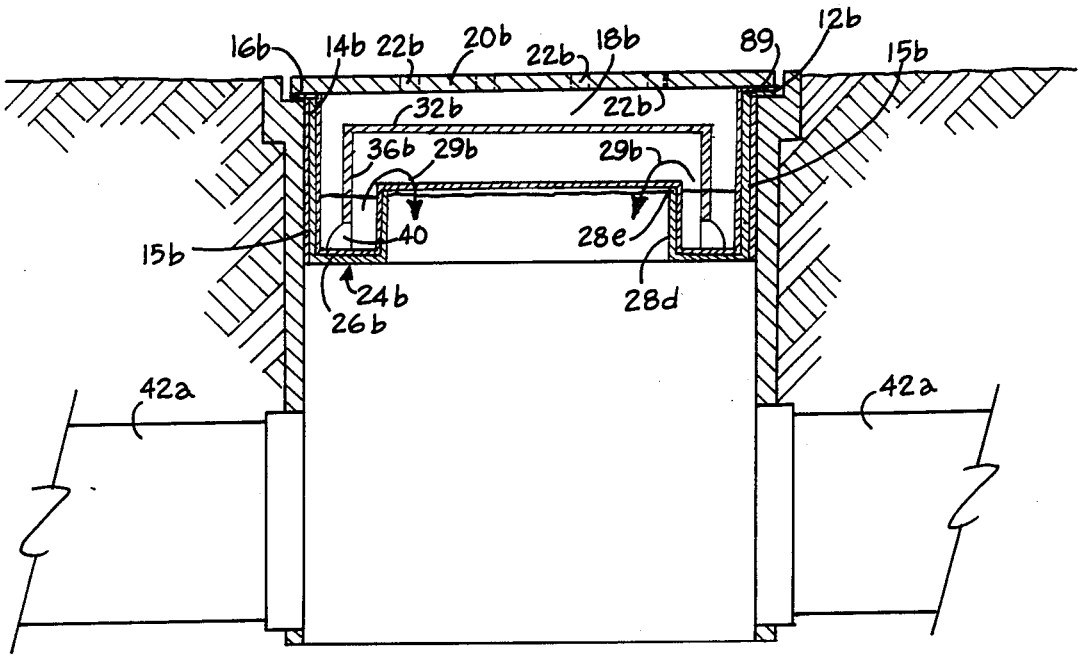
FIG. 11 is a vertical cross-sectional view taken along lines 11–11 of FIG. 10.

As can be seen in FIGS. 10 and 11, the length and width of insert 14b is less than the length and width of sewer inlet 10b, thereby allowing insert 14b to be placed in the interior of sewer inlet 10b. Preferably a sealing material 15b such as glue, cement, or the like is placed around the exterior walls of insert 14b to form a gas seal between the exterior of vertical wall 18b of insert 14b and the interior walls of sewer inlet 10b. Lip 16b of insert 14b defines an opening in the top of insert 14b through which liquid and other fluids may pass. Lying on top of lip 16b is removable cover 20b which has a series of channels or openings 22b therein through which liquids may flow downwardly into the interior of insert 14b. Cover 20b is a common sewer inlet cover which lies on top of a sewer inlet and is held in place by gravity.

At the bottom end of insert 14b is a trough generally indicated by the numeral 24b. Trough 24b is defined by horizontal rectangular shaped plate 26b connected to vertical walls 18b of insert 14b. Connected to rectangular plate 26b perpendicularly thereto is interior wall 28d. Trough 24b thus defines a compartment extending completely around the interior of insert 14b into which the water may be poured and contained. As can be seen in FIG. 11, the height of interior wall 28d is less than the height of exterior wall 18b of insert 14b.

Figure 12:
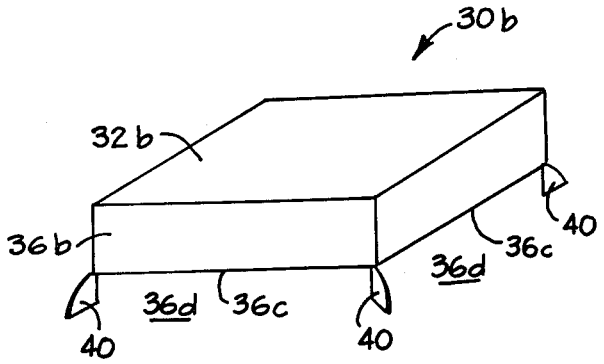
FIG. 12 is a perspective view of the lid shown in FIG. 11.

A lid generally indicated by the numeral 30b is shown in FIGS. 11 and 12. Lid 30b has a horizontal top plate 32b which is rectangular in shape. Extending perpendicularly down from the perimeter of rectangular top 32b are vertical exterior walls 36b of lid 30b. Walls 36b have a series of at least four legs therein at the bottom thereof which elevate the bottom edges 36c of walls 36b to define openings 36d through which water may flow. Legs 40 are preferably generally triangular in shape and are located at each of the four corners of lid 30b. The bottom edge 36c of openings 36d can be seen in FIG. 11 to be beneath the top edge 28e of trough 24b. Although walls 18b, 28b, and 36b are preferably vertical as shown in FIGS. 10, 11 and 12, they could be constructed at a small angle with the vertical as will be understood by those skilled in the art.

Thus when trough 24b is filled with water traveling downwardly through openings 22b of cover 20b, water will rise to the top edge 28e of trough 24b and will flow over the edge 28e through the opening defined by interior wall 28d of trough 24b in a direction indicated by the arrows 29b and downwardly to the sewer lines 42a connected to the base of sewer inlet 10b.

Figure 13:
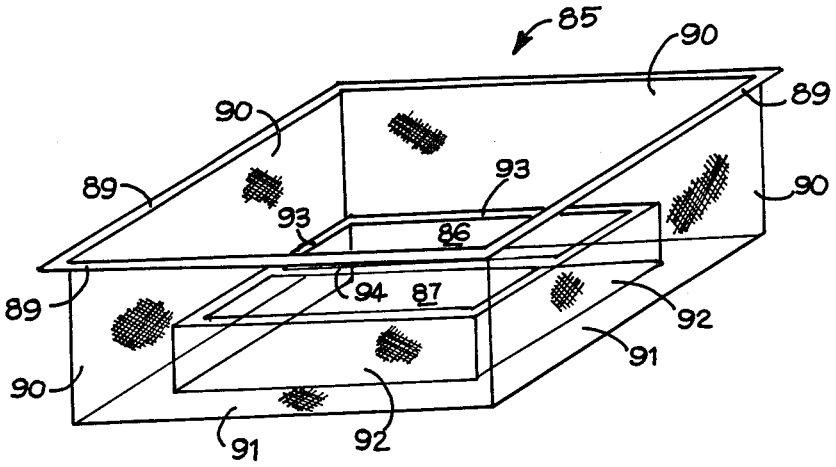
FIG. 13 is a perspective view of the screen assembly shown in FIG. 11.

To facilitate cleaning of insert 14b, a screen assembly or basket generally indicated by the numeral 85 is shown in FIGS. 10, 11 and 13. Screen assembly 85 is dimensioned to fit snugly into insert 14b as indicated in the drawings. The screen assembly has openings 86 and 87 separated by handle 94 through which water may flow as indicated by arrows 29b in FIG. 11.

Screen assembly 85 is generally rectangular and has a lip 89 which extends completely around the top of the assembly as indicated in FIG. 13 which is made of a porous metal screen. Connected to lip 89 are vertical sidewalls 90 also made from a porous screen.

Connected to the bottom of vertical sidewalls 90 is trough 91 which is perpendicular to vertical walls 90. Trough 91 supports and holds trash and other particulate material which may flow into sewer inlet 10b and facilitates easy removal and disposal of such trash when screen assembly 85 is removed from sewer inlet 10b.

Connected to the inner edge of trough 91 are vertical interior walls 92 which fit snugly against interior walls 28d of insert 14b. At the top of interior wall 92 is a lip 93 which extends completely around the top of interior walls 92 and rests on the top edge 28e of interior walls 28d of insert 14b. Connecting two opposite lips 93 is handle 94 which may be grasped to remove screen assembly 85 from insert 14b.

Thus, sewer insert 14b can easily be cleaned by removing cover 20b, lid 30b, and screen assembly 85. Screen assembly 85 and then be inverted to dump trash therefrom, and washed if desired. The entire screen assembly is preferably made from a porous plastic or metal screen, although handle 94, and lips 89 and 93 could be made from solid, non-porous strips of metal or plastic.

Although the preferred embodiments of the present invention have been disclosed and described in detail above, it should be understood that the invention is in no sense limited thereby, and its scope is to be determined by that of the following claims.

What is claimed is:

1. A selft sealing sewer cover assembly for preventing flammable gases from escaping from a sewer inlet comprising:

a. insert means having a top end and a bottom end for connection to a sewer inlet having generally vertical interior walls, said insert means having generally vertical walls on the exterior thereof for parallel alignment with said generally vertical interior walls of said sewer inlet, b. trough means connected to said bottom end of said insert means and extending completely around the interior of said generally vertical walls of said insert means for containing water, said trough means having an inner generally vertical wall defining an opening through which water overflowing from said trough means can flow, said inner generally vertical wall of said trough means having a height less than the height of said generally vertical wall of said insert means, c. removable screen assembly means for collecting trash adapted to fit inside said insert means and over said trough means, d. a lid means lying in said trough means and over and around said opening to prevent gases from traveling through said opening when said trough means is filled with water while permitting liquids to flow through said opening, and e. a cover means lying on top of said insert means, said cover means having a plurality of channels therein through which liquids may flow.

2. The cover assembly of claim 1 wherein said lid means has four legs supporting said lid meansin said trough.

3. The cover assembly of claim 2 wherein said generally horizontal bottom of said trough means is connected to the bottom end of said inner generally vertical wall of said trough means.

4. The cover assembly of claim 3 wherein said generally horizontal bottom of said trough means is connected to the bottom end of said generally vertical exterior walls of said insert means.

5. The cover assembly of claim 3 wherein said lid means has a generally horizontal top means having generally vertical exterior walls extending downwardly therefrom.

6. The cover assembly of claim 1 wherein said removable screen assembly is constructed from a porous metal or plastic screen.

7. The cover assembly of claim 6 wherein said screen assembly has the same shape as said insert means with said trough means connected thereto.

8. The cover assembly of claim 1 wherein said screen assembly has generally vertical walls on the exterior thereof for parallel alignment with said generally vertical walls on the exterior of said insert means.

9. The cover assembly of claim 8 wherein said second trough means is connected to the bottom of said generally vertical walls on the exterior of said screen assembly.

10. The cover assembly of claim 9 wherein said second trough means has an inner generally vertical wall defining an opening through which water overflowing from said trough means and said second trough means can flow, said inner generally vertical wall of said second trough means having a height less than the height of said generally vertical wall of said insert means.

11. The apparatus of claim 1 wherein said screen assembly has a handle connected thereto for removing said screen assembly from said insert means.

12. A self sealing sewer cover assembly for preventing flammable gases from escaping from a sewer inlet comprising:

a. insert means having a top end and a bottom end for connection to a sewer inlet having generally vertical interior walls, said insert means having generally vertical walls on the exterior thereof for parallel alignment with said generally vertical interior walls of said sewer inlet, b. trough means connected to said bottom end of said insert means and extending completely around the interior of said generally vertical walls of said insert means for containing water, said trough means having an inner generally vertical wall defining an opening through which water overflowing from said trough means can flow, said inner generally vertical wall of said trough means having a height less than the height of said generally vertical wall of said insert means, c. a lid means lying in said trough and over and around said opening to prevent gases from traveling through said opening when said trough means is filled with water while permitting liquids to flow through said opening, said lid means having four legs supporting said lid means in said trough, and d. a cover means lying on top of said insert means, said cover means having a plurality of channels therein through which liquids may flow.

13. The cover assembly of claim 12 wherein a seal means is connected to the exterior walls of said insert means and to the interior walls of said sewer inlet.

14. The cover assembly of claim 12 wherein said trough means has a generally horizontal bottom.

15. The cover assembly of claim 14 wherein said generally horizontal bottom of said trough means is connected to the bottom end of said inner generally vertical wall of said trough means.

16. The cover assembly of claim 15 wherein said generally horizontal bottom of said trough means is connected to the bottom end of said generally vertical exterior walls of said insert means.

17. The cover assembly of claim 12 wherein said lid means has a generally horizontal top means having generally vertical exterior walls extending downwardly therefrom.

18. The cover assembly of claim 17 wherein said generally vertical walls of said lid means have a plurality of openings in the lower portion thereof through which water may flow.

19. The cover assembly of claim 12 wherein said insert means has lip means around said top end thereof which rests of the top of said vertical walls of said sewer inlet.

20. A self sealing sewer cover assembly for preventing flammable gases from escaping from a sewer inlet comprising:

a. insert means having a top end and a bottom end for connection to a sewer inlet having generally vertical interior walls, said insert means having generally vertical walls on the exterior thereof for parallel alignment with said generally vertical interior walls of said sewer inlet, b. trough means connected to said bottom end of said insert means and extending completely around the interior of said generally vertical walls of said insert means for containing water, said trough means having an inner generally vertical wall defining an opening through which water overflowing from said trough means can flow, said inner generally vertical wall of said trough means having a height less than the height of said generally vertical wall of said insert means, c. a lid means lying in said trough and over and around said opening to prevent gases from traveling through said opening when said trough means is filled with water while permitting liquids to flow through said opening, and said lid means having a generally horizontal top means having generally vertical exterior walls extending downwardly therefrom, said generally vertical walls of said lid means have a plurality of openings in the lower portion thereof through which water may flow, and d. a cover means lying on top of said insert means, said cover means having a plurality of channels therein through which liquids may flow.

* * * * *